United States Patent [19]

Pettis, Jr. et al.

[11] 4,124,436

[45] Nov. 7, 1978

[54] CYLINDER LABEL APPLIER

[75] Inventors: Charles R. Pettis, Jr.; Victor Del Rosso, both of Ithaca; John W. Lindstrom, Newfield, all of N.Y.

[73] Assignee: Hi-Speed Checkweigher Co., Inc., Ithaca, N.Y.

[21] Appl. No.: 793,083

[22] Filed: May 2, 1977

[51] Int. Cl.[2] ..... B65C 9/26

[52] U.S. Cl. ..... 156/542; 156/249; 156/DIG. 33; 156/DIG. 37

[58] Field of Search ..... 156/541, 542, 571, 572, 156/DIG. 27, DIG. 33, DIG. 37, DIG. 38, DIG. 28, DIG. 30, DIG. 31, 230, 238, 247, 249

[56] References Cited

U.S. PATENT DOCUMENTS

| | | | |
|---|---|---|---|
| 3,616,094 | 10/1971 | Navin | 156/572 |
| 4,025,382 | 5/1977 | Del Rosso | 156/521 |

*Primary Examiner*—William A. Powell
*Assistant Examiner*—William H. Thrower

[57] ABSTRACT

A label applying apparatus and method is disclosed which rotates the label through a desired number of degrees of rotation before its application to an article in order that the label may be applied in a preferred orientation. A label dispenser delivers the label to a first vacuum foot which holds the label substantially parallel to the surface of the article upon which the label is to be placed. The label is then transferred to a second, reciprocating vacuum foot which rotates while it moves into contact with the article.

14 Claims, 11 Drawing Figures

CYLINDER LABEL APPLIER

BACKGROUND OF THE INVENTION

1. Field of the Invention

The present invention relates to an automatic label applying machine and method. More specifically, the present invention is directed to a label applying machine and method which rotates the labels before their application to the article in order to achieve a preferred orientation. The automatic label applying machine may operate in association with an automatic article weighing apparatus and a label printing mechanism.

2. Description of the Prior Art

In label applying devices heretofore proposed such as those disclosed in U.S. Pat. Nos. 3,329,550; 3,232,815; 3,616,016; 3,682,743 and 3,729,362 and co-pending U.S. patent application Ser. No. 595,741 filed July 14, 1975 by Victor Del Rosso entitled Label Applicator now U.S. Pat. No. 4,025,382 filed May 24, 1977, label applying mechanisms have been described which receive a label of a given orientation from a label dispensing device and apply the label to an article in that given orientation. This practice involves the disadvantage that the label is always placed on articles in the same orientation regardless of the orientation of the articles passing through the labeling station. Consequently, if for some production related reason the articles passing through the labeling station are oriented differently from the orientation of the label placed thereon or if during production run the article orientation is changed, all or some of the labels would be applied to the article in an orientation other than that which was preferred. In many cases this is an undesirable or unacceptable result: the correction of which required an article reorientation station upstream of the labeling station.

Thus is posed the problem of finding a method and apparatus which would increase the flexibility of the article labeling station itself and which would eliminate the need for an upstream article reorientation station, thereby reducing the cost and complexity of the production line. Such a method and apparatus should be capable of providing label rotation through one of a number of preselected angles prior to application to the article so as to accomodate operation of the weighing and labeling station with any one of a number of article orientations.

SUMMARY OF THE INVENTION

The above recited objects are realized by the present invention which includes a method and apparatus designed to receive a label in a first orientation and to rotate the label to one of a number of possible second orientations prior to the application of the label onto the article to be labeled. Generally, a label vacuum applicator foot mounted for rotation and reciprocation receives the label in one orientation in a withdrawn position and rotates the label to a second desired orientation during its movement toward the article.

In greater detail, a vacuum foot horizontally pivots to a first position which is best adapted to receive a label with pressure sensitive adhesive on one side from a label dispenser which "peels" the label from a carrier tape and feeds it to the vacuum foot. After having received the label from the dispenser, the foot pivots to a second position which disposes the label above and generally parallel to the surface of the article to be labeled. The label is then transferred to a vacuum cup which reciprocates in a direction substantially perpendicular to the surface of the article while at the same time rotating through a desired angle.

A cam pin is fixed to the rod on which the vaccum cup is mounted and a cam slot is provided to guide the cam pin in a helical path when the rod is reciprocated. Moving the cam slot toward or away from the article so that the cam pin and the rod start at different positions along the cam slot provides a means for adjusting the label applicator in order to permit the label to be rotated through different selected predetermined angles.

BRIEF DESCRIPTION OF THE DRAWINGS

The present invention may be better understood and its numerous objects and advantages will become apparent to those skilled in the art by reference to the accompanying drawings wherein like reference numerals refer to like elements in the several figures and in which.

DESCRIPTION OF THE PREFERRED EMBODIMENT

Figure 1:
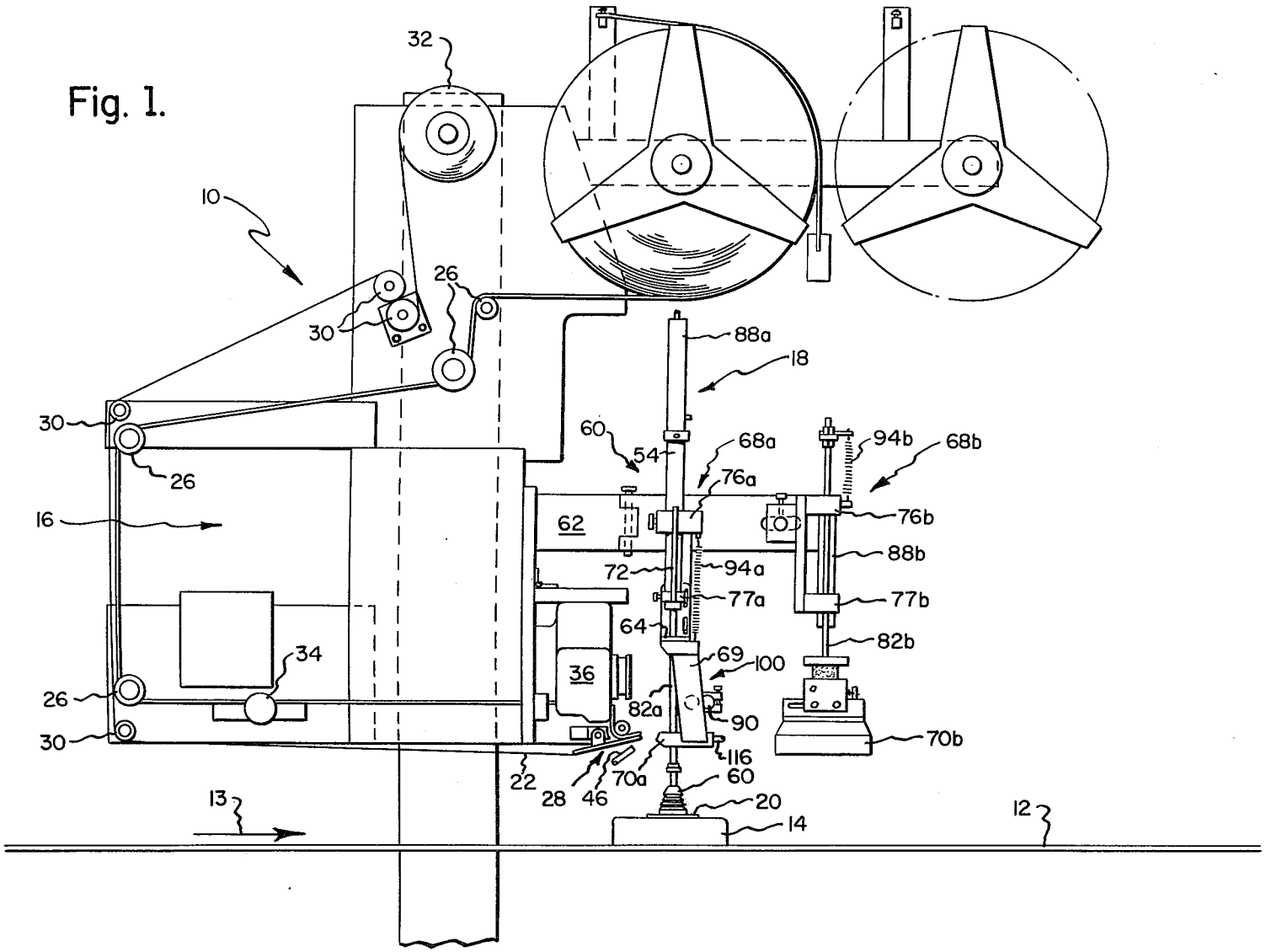
FIG. 1 is an elevational view showing a label applicator formed in accordance with the present invention.

Reference is now made particularly to FIG. 1 wherein 10 is employed to generally designate a labeling station suitable for use in an article weighing and labeling system. A continuously driven endless conveyor 12 serves to transport articles 14 successively through the weighing and labeling stations in the direction indicated by arrow 13 in FIG. 1. The term "article" is used generically herein to include an individual article as well as a package including one or more articles. Further, while for purposes of simplicity, articles 14 are depicted in the drawings as being of box-like configuration and as having planar upper or label receiving surfaces, it will be understood that the invention is also suitable for the use of applying labels to articles having contoured or irregular upper surfaces, such as would be defined by wrapping a clear plastic protective wrapper about a "tray" filled with a "mound" of hamburger or a plurality of chicken parts. In such a circumstance, it should be understood that the irregular surface may be thought of as having a planar label receiving surface which is generally perpendicular to the direction in which the surface is facing.

Labeling station 10 generally includes a label supply and printer mechanism 16, which may be essentially conventional in construction, and a label applicator mechanism 18 which includes means for receiving and moving the label 20 and which is formed in accordance with the present invention. Labels 20 to be applied to articles 14 are preferably of the type which have a pressure sensitive adhesive coated rear surface permitting them to be individually "peeled" from a carrier tape 22 and them adhered directly to a surface of the article 14. To this end, mechanism 16 preferably includes suitable means for mounting a supply roll from which carrier tape 22 bearing labels 20 is withdrawn and passed via guide or transport rollers 26 to a label separator or "peeling" device 28; carrier tape 22 then being passed from device 28 over guide or transport rollers 30 to a driven takeup reel 32. Mechanism 16 would also preferably include a first or constant data printer 34, which is adapted for instance to print the name of the articles being weighed on all of the labels and a second or variable printer 36, which is adapted to print individual article information, such as net weight, price per pound and total weight on the successively presented labels. Of course, transport of articles 14 through the weighing and labeling stations is suitably controlled to insure that the labels are applied to the articles to which their printed information pertains.

Figure 2:
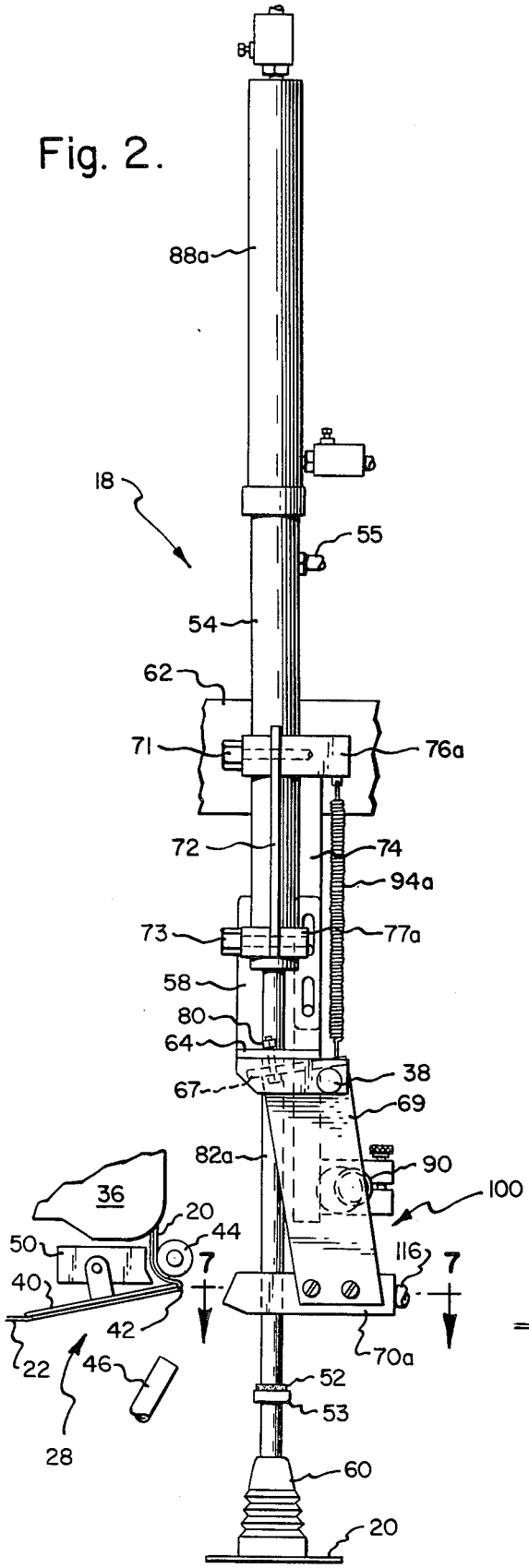
FIG. 2 is an enlarged elevational view of the label applicator of FIG. 1 showing the device in its label applying position.
Figure 3:
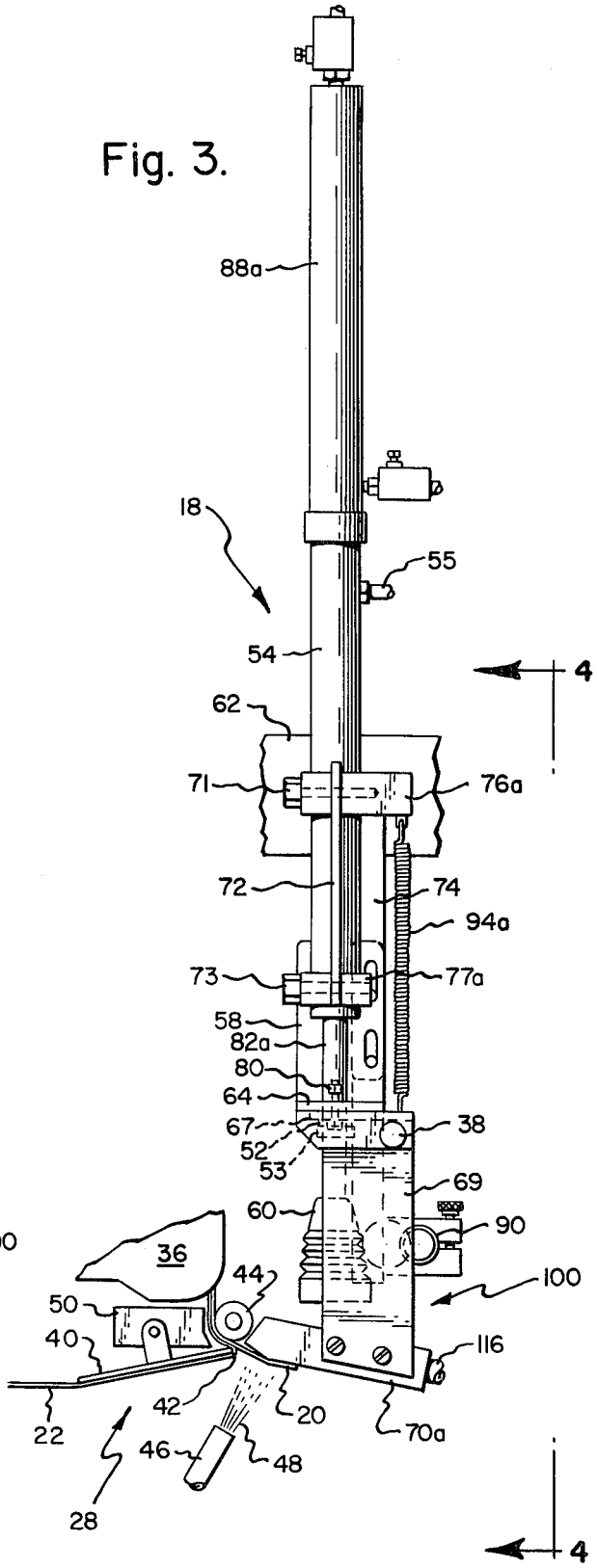
FIG. 3 is a view similar to that of FIG. 2 showing the device in its retracted, label receiving position.
Figure 5:
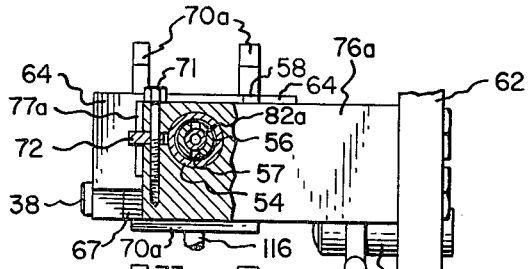
FIG. 5 is a cross-sectional view taken generally along the line 5—5 of FIG. 4.
Figure 6:
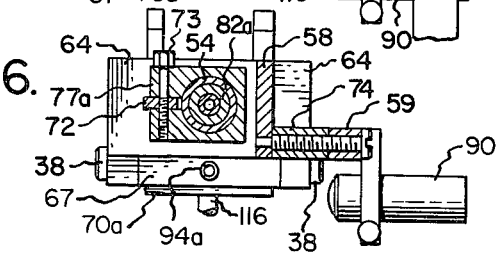
FIG. 6 is a cross-sectional view taken generally along the line 6—6 of FIG. 4.

A preferred form of label separator device 28 is shown in FIGS. 1–3 as including a label peeler plate 40, which defines a peeling edge 42 having a relatively small radius of curvature; a guide roller 44 for guiding carrier tape 22 for travel over peeling edge 42; and an air tube 46 for creating label supporting air jets 48. Many commercially available labels readily separate from their carrier tapes when the latter is forced to abruptly change directions, while the label is unconstrained except for its temporary bond to the carrier tape. Air jets 48 are directed upwardly towards leading edge 42 and in the direction of conveyor travel, as indicated, in order to insure proper initial separation of the leading edge of the label 20 from the carrier tape and thereafter insure that the label is supported in an essentially horizontally disposed position during the following label separation and pick-off operation. Co-pending U.S. patent application Ser. No. 595,741 filed July 14, 1975 by Victor Del Rosso entitled "Label Applicator" now U.S. Pat. No. 4,025,382 filed May 24, 1977 discusses a similar labeling station and label separator and may be referred to for greater detail.

Applicator mechanism 18 generally comprises a mounting assembly 62 and first and second supporting assemblies **68*a* and 68*b*, which serve to suspend the label applicator including a first vacuum foot 70*a* and a second vacuum foot or vacuum cup 60, and label compression foot 70*b*, respectively. The supporting assembly 68*b* for compression foot 70*b* is slideably supported for vertically reciprocating movement intermediate upper and lower positions by support means 76*b* and 77*b*. Operator 88*b*, which is preferably a pneumatic cylinder, is provided with an extensible piston rod (not shown) whose upper end is attached to the upper end of a slide rod 82*b*. Operator 88*b* is normally extended such that the compression foot 70*b* is retained in an initial raised position against the bias of gravity and the pull of spring 94*b*. When the operator 88*b* retracts its piston rod, spring 94*b* assists the force of gravity in driving the compression foot 70*b* downwardly to a lower position in which it engages the top of the article 14 where it applies a pressure to press the label against the top of the article 14**.

Turning now to the applicator mechanism 18, the general operation and design of the mechanism will be described hereunder in a preferred embodiment: the details of which are not intended to be limiting on the scope of the invention. As a label is "peeled" from its backing strip 22 by the label peeling mechanism 28, a first vacuum foot **70*a* is in a position pivoted to the left as shown in FIG. 3 ready to receive the label 20. As the label 20 is "peeled" off and advanced to the right, air jets 48 from nozzle means 46 support the label 20 against gravity until the label is "grabbed" and held by a vacuum drawn through orifices 112 on the bottom surface of foot 70*a* and through channels 114 and vacuum nipple 116**.

After transfer of the label, double acting air cylinder **88*a* drives slide rod 82*a* downwardly toward conveyor 12. As slide rod 82*a* moves down, foot 70*a* is pivoted to a generally horizontal position as shown in FIG. 2. When in this position, the U-shaped foot 70*a* holds the label 20 in a horizontal position best adapted for engagement by and transfer to the downwardly progressing second vacuum foot or cup 60. As cup 60 strikes the upper surface of the label 20 exposed by the open U-shaped of the foot 70*a*, the cup 60 pushes the label down and breaks the vacuum applied by foot 70*a* while at the same time applying a vacuum of its own in order to complete the transfer. Subsequent movement of the rod 82*a* brings the label 20 into contact with the article 14**.

During said subsequent movement, rod **82*a* as well as the vacuum cup 60 and suspended label 20 are rotated through a preselected number of degrees by a means which operatively engages rod 82*a* so that the orientation of the label as it is applied to the article 14 matches the orientation of the article 14. Of course, if no rotation is required to produce a match, no rotation is effected. After the label 20 and the vaccum cup 60 strike the surface of the article 14, the negative pressure drawn through cup 60 and hollow slide rod 82*a* is released and label transfer is completed whereupon the slide rod 82*a* is retracted to its initial position and vacuum foot 70*a*** is again swung to its leftmost position preparatory for receiving the next label.

Vacuum foot **70*a* is part of a label positioning assembly generally indicated by numeral 100 which comprises upper horizontal plate 67, a pair of arms 69 attached thereto and vacuum foot 70*a* itself. The label positioning assembly 100 is pivotally mounted by pivot pins 38 on a generally horizontal base 64 in such a way as to locate plate 67 under horizontal base 64 so that clockwise rotation of the peeler assembly 100, as shown in FIG. 3, is limited by contact with the base 64. Counter clockwise movement of peeler assembly 100, on the other hand, is limited by limit bolt 80 which passes through adjacent holes in base 64 and plate 67 so that adjustable nuts on bolt 80 engage the top and bottom surfaces of horizontal base 64 and plate 67 respectively when assembly 100 is in its leftmost position as shown in FIG. 2. Assembly 100 is biased in the counter clockwise direction by spring 94*a* which is fixed to upper support bracket 76*a***.

The label positioning assembly 100 is swung to its leftmost position by the engagement of collar 53 and resilient washer 52 carried on the slide rod **82*a* with the bottom of plate 67 when the rod 82*a* is retracted to its uppermost position. The pressure applied to the bottom of plate 67** overcomes the spring bias exerted by spring 94*a*. As may be appreciated, the uppermost position of slide rod 82*a* is therefore limited by the position of the horizontal base 64.

Figures 10, 11:
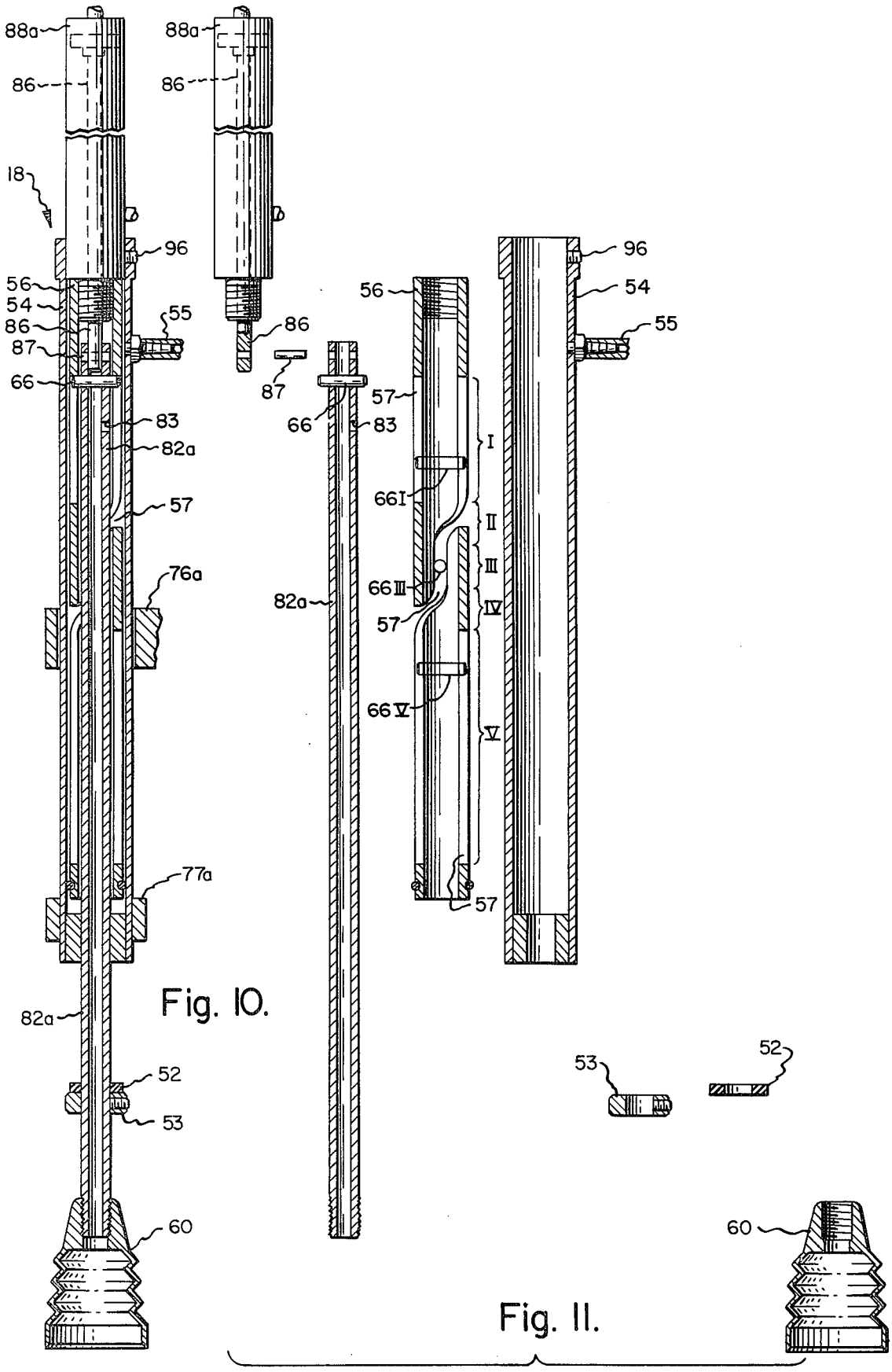
FIG. 10 is a cross-sectional view of the label applicator mechanism 18 showing the assembly of the cylinders of the mechanisms.
FIG. 11 is a cross-sectional view of the parts of the label applicator mechanism 18 of FIG. 10 shown in a disassembled condition.

Base 64 is adjustably suspended from support bracket 76*a* through intermediate support members 74 and 58. Support member 74 also supports member 59 which in turn provides a mount for optical sensor 90 which is arranged to detect the position of assembly 100 by means of reflected light from reflector 92 carried by assembly 100. Rotation of rod 82*a* through the desired number of degrees is accomplished by any suitable means with the preferred embodiment including the engagement of camming surface or cam slot 57 formed in the guide cylinder 56 by cam pin 66 located at the upper end of slide rod 82*a*. As can best be seen in FIG. 10, slide rod 82*a* is connected at its upper end to piston rod 86 of the double acting air cylinder 88*a* by means of a pin or other fastening device 87. Cam pin 66 projects outwardly on both sides of slide rod 82*a* to be received within the two cam slots 57 in opposite sides of guide cylinder 56. Guide cylinder 56 itself is fastened to the housing of the double acting air cylinder 88*a* by means of a threaded bushing at its upper end so that when the guide rod 82*a* is moved relative to the guide cylinder 56 the cam pin 66 slides within the cam slots 57.

Cam slots 57 have a first upper vertical region I, a second helical region II, which moves the slot around the guide cylinder 56 through 90°, a third central vertical region III, a fourth helical region IV, which moves the guide slots 57 another 90° around the surface of the guide cylinder 56, and a fifth vertical region V at the lower end of the guide cylinder 56. Thus, as slide rod 82*a* is moved from its vertically uppermost position the engagement of the cam pin 66 with the surfaces of the cam slots 57 in the guide cylinder 56 cause the guide rod 82*a* to first undergo no rotation, next a rotation through 90 degrees as guide pin 66 traverses the second region of guide slot 57 and to undergo a further rotation of 90° as the guide pin 66 traverses the fourth region of the guide slots 57. In this manner, slide rod 82*a* and consequently vacuum cup 60 and the suspended label 20 experience a total rotation of 180°.

If less than a 180° rotation is desired, it can be seen that a vertical repositioning of the guide cylinder 56 in an upward direction by a distance which would place the starting position of guide pin 66 in the third region of the guide slots 57 would be effective to cause the guide pin 66 and consequently the slide rod 82*a* to experience a rotation of only 90° as it traverses from its uppermost position in region III to its label applying position. Furthermore, if no label rotation was desired, vertical adjustment of the guide cylinder 56 to a raised position which would place the guide pin 66, when in its original starting and uppermost position, in the fifth region of guide slots 57 would eliminate rotation of the slide rod 82*a* as the slide rod 82 moves from its retracted position to its vertically downward label applying position.

Thus, in order to make the above described adjustments, means are provided for permitting the relative adjustment of the guide cylinder 56 vertically with respect to the uppermost position of slide rod 82*a*. Since guide cylinder 56 is suspended from the double acting air cylinder 88*a*, it can be seen that the vertical displacement of cylinder 88*a* in an upward direction will also cause the guide cylinder 56 to move up so that the guide pin 66 starts at relatively lower positions in the cam slot 57. Double acting air cylinder 88*a* is held in position by attachment to housing 54 by set screw 96. Housing 54 is adjustably mounted from member 62 by support means 76*a*, vertical support member 72 and support bracket 77*a*.

Figure 4:
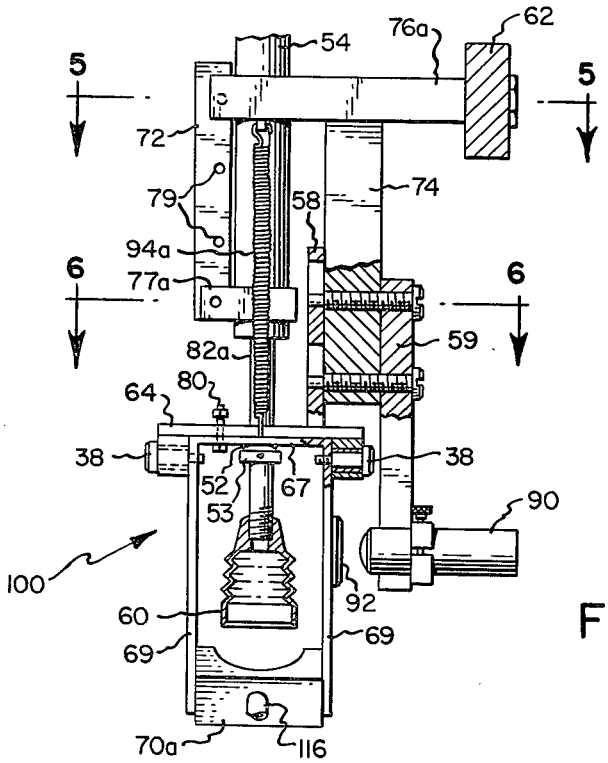
FIG. 4 is a sectional view taken generally along the line 4—4 of FIG. 3.
Figure 8:
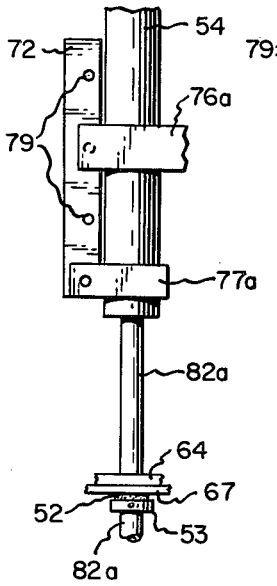
FIG. 8 is a view similar to that of FIG. 4 showing a second adjusted position.
Figure 9:
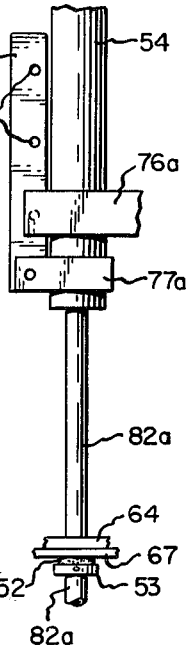
FIG. 9 is a view similar to that of FIG. 8 showing a third adjusted position.
Figure 7:
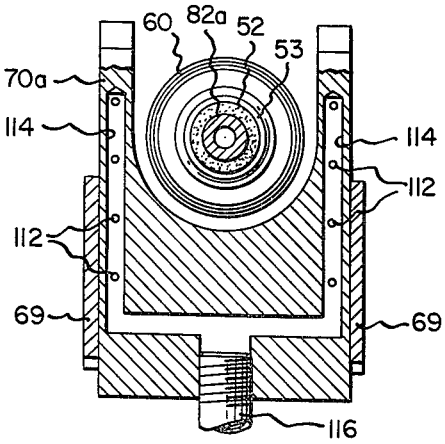
FIG. 7 is an enlarged cross-sectional view taken along the line 7—7 of FIG. 2.

Support bracket 77*a* is fixed to the bottom end of housing cylinder 54 as well as to the bottom end of vertical support member 72. Vertical support member 72 includes a plurality of vertically displaced ajustment holes 79 therethrough which permit support member 72 to be vertically adjusted to a plurality of positions. As best seen in FIGS. 2 and 3, fasteners 71 and 73 which may be machine screws or other pin fasteners, are provided to fasten support member 72 to member 76*a* and bracket 77*a* respectively. Housing cylinder 54 slideably passes through an opening in support member 76*a* and may be raised relative to support member 76*a* and relative to the stationary horizontal support plate 64 by removal and reinsertion of pin 71 in a different hole 79 as illustrated in FIGS. 4, 8, and 9. Since the upward vertical movement of slide rod 82*a* is limited by stationary horizontal support plate 64 and by collar 52, such a readjustment of the position of cylinder 54 raises guide cylinder 56 mounted interior thereto relative to the slide rod 82*a* so that the cam pin 66 may assume an initial starting position in either one of the first, third or fifth sections of the cam slot 57. Therefore, the adjusted position show in FIG. 4 would result in a 180 degree rotation of slide rod 82*a* and the adjusted positions shown in FIGS. 8 and 9 would result in 90° and 0° rotations respectively.

As may be appreciated, a vacuum or negative pressure is drawn through the vacuum cup 60 and through tubular slide rod 82*a* by way of radial passage 83 in tube 82*a* which permits fluid communication with the interior of cylinder 54. Vacuum nipple 55 is provided on cylinder 54 thereby permitting a vacuum to be drawn in the interior of cylinder 54. Accordingly, pressure may be applied and removed at cup 60 in a timed manner which draws up and releases the label at appropriate moments.

It should also be appreciated that the operation of double acting air cylinder 88*a* is appropriately timed in order to begin downward movement of slide rod 82*a* as article 14 comes into position and after the label 20 has been transferred from the label dispenser 28 to the vacuum foot 70*a*. In this respect, optical scanner 90 is useful in deriving a timing and actuation signal for the appropriate operation and timing of the synchronized label applying mechanism, label dispenser and conveyor 12. Additionally, appropriate other signals may be obtained by suitable proximity detectors such as a detector which indicates the presence of an article 14 at a given position on the conveyor.

What is claimed is

1. An improved label applying apparatus for applying labels having pressure sensitive adhesive on one side thereof to articles being transported along a conveyor without touching the adhesive sides of the labels, said apparatus of the type adapted to receive labels from a label source, said improved apparatus comprising:

(a) first means for receiving said label and for moving said label into contact with a label receiving surface of the article, said first means mounted for reciprocation along a direction substantially perpendicular to the label receiving surface of the article;

(b) second means operatively connected to said first means for reciprocating said first means along said direction toward said article;

(c) third means operatively engaging said first means for causing said first means to rotate through a selected angle around an axis of rotation parallel to said direction while said label is moving toward said article, said third means including a cam surface having a helical portion and a means for engaging said cam surface and for rotating said first means consistant with said helical portion; and (d) means for adjustably positioning one of said cam surface and said cam surface engaging means relative to the other along said direction without repositioning said first means, whereby the various different relative positions of said cam surface and said engaging means cause said first means to rotate through various different angles when said first means moves said label toward said article.

2. An improved label applying apparatus for applying labels having pressure sensitive adhesive on one side thereof to articles being transported along a conveyor without touching the adhesive sides of the labels, said apparatus of the type adapted to receive labels from a label source, said improved apparatus comprising:

(a) first means for receiving said label and for moving said label into contact with a label receiving surface of the article, said first means including a longitudinally extending member mounted for reciprocation along a direction substantially perpendicular to the label receiving surface of the article;

(b) second means operatively connected to said first means for reciprocating said first means along said direction towards said article;

(c) third means operatively engaging said first means for causing said first means to rotate through a selected angle about an axis of rotation parallel to said direction while said label is moving toward said article, said third means including a tube having a cam surface, said cam surface comprising a cam slot with a helical portion, and said third means including means for engaging said cam surface and for rotating said first means consistant with said helical portion, said longitudinally extending member of said first means being mounted on the interior of said tube; and (d) means for adjustably positioning one of said cam surface and said cam surface engaging means relative to the other along said direction, whereby the various different positions of said cam surface and said engaging means cause said first means to rotate through various different angles when said first means moves said label toward said article.

3. The improved label applying apparatus as recited in claim 2 wherein said cam slot includes a helical section connected at either end to a slot section extending along said direction substantially perpendicular to the label receiving surface of the article.

4. The improved label applying apparatus as recited in claim 3, further including means for limiting the initial maximum displacement from the article of said label receiving and moving means whereby said cam slot may be adjustably positioned relative to said cam surface engaging means so that said cam surface engaging means may have different initial positions along the length of said cam slot.

5. The improved label applying apparatus as recited in claim 4 wherein said cam slot includes two helical sections each turning through an angle of 90°.

6. An improved label applying apparatus for applying labels having pressure sensitive adhesive on one side thereof to articles being transported along a conveyor without touching the adhesive sides of the labels, said apparatus of the type adapted to receive labels from a label source, said improved apparatus comprising:

(a) a label receiving means for receiving and supporting said label by contacting only its non-adhesive side, said means being pivotally mounted for pivotal movement between a first label receiving position adjacent to said label source and a second pivotally and laterally displaced position; and (b) an axially longitudinally extended label applying means disposed with its longitudinal axis generally perpendicular to the receiving surface of said article for receiving the label from said label receiving means in said second position and for moving the label generally parallel with said longitudinal axis from said second position into contact with the label receiving surface of said article without touching the adhesive side of the label.

7. The improved label applying apparatus as recited in claim 6 wherein said label receiving means is adapted to permit the passage of said label applying means therethrough in order to permit said label applying means to be able to engage the surface of the label facing away from the article and to move the label from said second position into contact with said article.

8. The improved label applying apparatus as recited in claim 7 wherein said label receiving means is pivotally mounted for pivotal movement around an axis substantially parallel to the label receiving surface of the article.

9. The improved label applying apparatus as recited in claim 8 wherein said label receiving means includes a label holding foot including channels and orifices through which a negative pressure is drawn for attracting and holding said label.

10. The improved label applying apparatus as recited in claim 9 wherein said label holding foot includes a surface facing said article when said label receiving means is in its second pivotally displaced position and wherein said orifices are formed in said surface.

11. The improved label applying apparatus as recited in claim 6 further including means operatively engaging said label applying means for causing said label applying means to rotate through a selected angle around an axis of rotation substantially perpendicular to the label receiving surface of said article.

12. The improved label applying apparatus as recited in claim 11 wherein said means for causing said label applying means to rotate through a selected angle includes a cam surface including a helical portion and wherein said label receiving means includes means for engaging said cam surface and for rotating said label receiving and moving means consistant with said helical portion.

13. The improved label applying apparatus as recited in claim 12 further including means for permitting said cam surface to be adjustably mounted at selected positions relative to said engaging means along said direction.

14. The improved label applying apparatus as recited in claim 13 wherein said helical portion of said cam surface is connected to a straight portion at either end thereof.

* * * * *